US009970213B2

(12) United States Patent
Li et al.

(10) Patent No.: US 9,970,213 B2
(45) Date of Patent: May 15, 2018

(54) METAL PROTECTIVE NET AND PROTECTION MONITORING SYSTEM

(71) Applicant: Beijing Long Fly Science and Technology Co. Ltd., Beijing (CN)

(72) Inventors: Jianqun Li, Beijing (CN); Jingguo Yao, Langfang (CN); Heshen Mao, Langfang (CN)

(73) Assignee: Beijing Long Fly Science and Technology Co. Ltd., Beijing (CN)

( * ) Notice: Subject to any disclaimer, the term of this patent is extended or adjusted under 35 U.S.C. 154(b) by 0 days. days.

(21) Appl. No.: 15/492,191

(22) Filed: Apr. 20, 2017

(65) Prior Publication Data

US 2017/0306642 A1 Oct. 26, 2017

(30) Foreign Application Priority Data

Apr. 20, 2016 (CN) ..... 2016 2 0336691.7

(51) Int. Cl.

| | |
|---|---|
| ***E04H 17/02*** | (2006.01) |
| ***E04H 17/06*** | (2006.01) |
| ***G08B 13/12*** | (2006.01) |
| ***G08B 13/24*** | (2006.01) |

(52) U.S. Cl.

CPC ..... *E04H 17/06* (2013.01); *E04H 17/02* (2013.01); *G08B 13/122* (2013.01); *G08B 13/2497* (2013.01)

(58) Field of Classification Search

CPC ..... E04H 17/00; E04H 17/02; E04H 17/06; A01K 3/00; A01K 3/005; G08B 13/122

See application file for complete search history.

(56) References Cited

U.S. PATENT DOCUMENTS 4,031,284 A * 6/1977 Ingraham ..... E04H 17/02 174/6
4,093,187 A * 6/1978 Robinson ..... E01F 7/00 256/49
4,196,890 A * 4/1980 Einhorn ..... E04H 17/02 256/10

(Continued)

FOREIGN PATENT DOCUMENTS

WO WO-9006674 A1 * 6/1990 ..... A01K 3/005

*Primary Examiner* — Daniel J Wiley

(74) *Attorney, Agent, or Firm* — Marshall, Gerstein & Borun LLP

(57) ABSTRACT

The present invention relates to a metal protective net, including: multiple steel wires arranged in parallel; multiple metal connecting sheets arranged in parallel, where the metal connecting sheets and the steel wires are arranged to intersect with each other at multiple intersections without being connected; insulating members which are provided between the steel wires and the metal connecting sheets and located at the intersections, and fixedly connected therewith; and connecting terminals, where both ends of each steel wire each are connected with one connecting terminal, and both ends of each metal connecting sheet each are connected with one connecting terminal; and a monitoring device electrically connected with the connecting terminals. The steel wires and the metal sheets, which form the metal protective net, are not electrically conductive with each other, forming many individual loops. If the metal net is broken, an alarm can be sent by the monitoring device.

20 Claims, 5 Drawing Sheets

(56) References Cited

U.S. PATENT DOCUMENTS

| | | | | |
|---|---|---|---|---|
| 4,916,433 | A * | 4/1990 | ver Loren van Themaat | G08B 13/122 256/12 |
| 5,268,672 | A * | 12/1993 | Kerr | G08B 13/169 340/565 |
| 5,852,402 | A * | 12/1998 | Perry | G08B 13/122 256/10 |
| 6,264,172 | B1 * | 7/2001 | Ball | A01K 3/005 256/10 |
| 6,712,339 | B1 * | 3/2004 | Smith | A01K 3/005 256/10 |
| 2008/0237558 | A1 * | 10/2008 | Jensen | A01K 3/005 256/10 |
| 2009/0032788 | A1 * | 2/2009 | Adler | E04H 17/00 256/11 |
| 2009/0179182 | A1 * | 7/2009 | Gladstone | A01K 3/005 256/32 |
| 2012/0205602 | A1 * | 8/2012 | Walker | A01K 3/005 256/10 |

* cited by examiner

METAL PROTECTIVE NET AND PROTECTION MONITORING SYSTEM

CROSS-REFERENCE TO RELATED APPLICATION

The present application claims priority to a Chinese patent application No. CN201620336691.7, filed with the State Intellectual Property Office on Apr. 20, 2016, entitled "Metal Protective Net", which is incorporated herein by reference in its entirety.

TECHNICAL FIELD

The present invention relates to the technical field of monitoring and protection, and particularly to a metal protective net and a protection monitoring system.

BACKGROUND ART

In the prior art, boundary protection and boundary monitoring are two separate parts. Specifically, a common protective net is installed, followed by a monitoring device, which makes it unable to integrate protection with monitoring.

DISCLOSURE OF THE INVENTION

In view of such deficiencies in the prior art, an object of the present invention is to provide a metal protective net.

Another object of the present invention is to provide a protection monitoring system having the above metal protective net.

Embodiments of the present invention are realized through the following technical solutions.

A metal protective net, including:

a plurality of steel wires, where the plurality of steel wires are arranged in parallel;

a plurality of metal connecting sheets, where the plurality of metal connecting sheets are arranged in parallel, and the metal connecting sheets and the steel wires are arranged to intersect with each other at a plurality of intersections without being connected;

insulating members, where the insulating members are provided between the steel wires and the metal connecting sheets and located at the intersections, and fixedly connected with the steel wires and the metal connecting sheets;

connecting terminals, where both ends of each of the steel wires each are connected with one connecting terminal, and both ends of each of the metal connecting sheets are connected with two different connecting terminals; and a monitoring device, where the connecting terminals are electrically connected with the monitoring device.

With the provision of the insulating members and the monitoring device, the steel wires and the metal sheets, which form the metal protective net, may be insulated from each other, i.e., not electrically conductive with each other, thereby forming many individual independent loops. If the metal net is damaged or broken, an alarm of the breakage information may be sent by the monitoring device (which may be an on-site audible and visual alarm, or may be uploaded in a wired or wireless way to an upper device for alarming). In the present invention, a multi-loop information transmitting channel is formed, and the integration of protection and monitoring is achieved.

Furthermore, the metal connecting sheet includes:

a first metal sheet, where the first metal sheet is arranged on one side of the plurality of steel wires, forming a plurality of intersections;

a second metal sheet, where the second metal sheet is arranged on the other side of the plurality of steel wires and located at the plurality of intersections;

the steel wire is fixed, at each of the plurality of intersections, with one of the insulating members by bonding or riveting, and the first metal sheet and the second metal sheet are both fixedly connected with the insulating member.

By providing two layers of metal sheets and locating the two layers of metal sheets at both sides of the steel wires respectively, the metal sheets may hold the insulating member tightly, forming tight intersections in the metal net.

Furthermore, both the first metal sheet and the second metal sheet are fixedly connected with the insulating member by mold stamping.

Furthermore, the insulating member is of a cylindrical shape, and the insulating member is sleeved outside the steel wire, and fixed with the steel wire. The metal sheets are bonded or riveted on an outer wall the insulating member.

Furthermore, the insulating member is of a cylindrical shape, and the insulating member is sleeved outside the steel wire, and fixed with the steel wire by bonding or riveting.

By setting the insulating member to be in a cylindrical shape and sleeved outside the steel wire, the steel wire can be effectively isolated from the metal sheet.

Furthermore, the first metal sheet and the second metal sheet are provided thereon with burrs, with the burrs located between adjacent two of the steel wires.

By providing burrs on the metal sheets, the protective effect can be further enhanced in the aspect of hardware.

Furthermore, every adjacent two of the steel wires are connected end to end successively via a conducting wire, so as to form a first conductor. Every adjacent two of the metal connecting sheets are connected end to end successively via a conducting wire, so as to form a second conductor. One end of the first conductor and one end of the second conductor are both connected, via a conducting wire, with one connecting terminal, and the other end of the first conductor and the other end of the second conductor are both connected, via a conducting wire, with one connecting terminal.

Furthermore, the steel wire is a steel thread or iron thread having a cross-sectional diameter of 4 mm to 5 mm.

A metal protective net, including:

a plurality of first conductors, where the plurality of first conductors are arranged side by side, and connected end to end successively, forming a continuous conductive path;

a plurality of second conductors, where the plurality of second conductors are arranged side by side, and connected end to end successively, forming a continuous conductive path; and insulators;

where the first conductors and the second conductors are arranged to intersect with each other, and the first conductors and the second conductors are connected at intersections to form a net; the insulators are provided at the intersections between the first conductors and the second conductors, and the insulators are configured to make the first conductors and the second conductors non-conductive with each other.

Furthermore, the plurality of first conductors are formed by bending one metal conducting wire at several points.

Furthermore, the metal conducting wire is wrapped by an insulating layer, and a part of the insulating layer, which is located at the intersection between the first conductor and the second conductor, forms the insulator.

Furthermore, the insulator is an insulating bush sleeved on the first conductor.

Furthermore, the second conductor includes a first metal sheet and a second metal sheet which are arranged opposite to each other, and the first conductor is sandwiched between the first metal sheet and the second metal sheet.

Furthermore, the first metal sheet and the second metal sheet are fixedly connected by stamping.

Furthermore, the first metal sheet is provided thereon with a first groove, the second metal sheet is provided thereon with a second groove with the second groove being opposite to the first groove, and the first conductor is clamped in the first groove and the second groove.

Furthermore, the first metal sheet includes a plurality of first metal segments provided at intervals, and first half cylinders connecting adjacent two of the first metal segments, with the first half cylinder defining the first groove; the second metal sheets includes a plurality of second metal segments provided at intervals, and second half cylinders connecting adjacent two of the second metal segments, with the second half cylinder defining the second groove.

Furthermore, the plurality of second conductors are provided thereon with first spines.

Furthermore, the plurality of second conductors are connected end to end successively via a conductive connecting piece.

Furthermore, the connecting piece is provided thereon with a second spine.

A protection monitoring system includes any one of the above metal protective nets. The protection monitoring system further includes a monitoring device, and the monitoring device is electrically connected with both the first conductors and the second conductors.

Furthermore, the protection monitoring system further includes an upper device in communication with the monitoring device.

The technical solutions of the present invention at least have the following advantages and beneficial effects:

with the metal protective net provided in the embodiments of the present invention, the first conductor and the second conductor can not only provide physical protection, but also play a role in transmitting an electrical signal as being configured to be electrically connected with the monitoring device. Once either of the first conductor or the second conductor is damaged, the monitoring device can send an alarm signal (which may trigger on-site audible and visual alarming, or may be uploaded in a wired or wireless way to an upper device for alarming). The metal protective net provided in the embodiments of the present invention can make it easy to implement integration of protection and monitoring.

BRIEF DESCRIPTION OF DRAWINGS

In order to more clearly illustrate technical solutions of embodiments of the present invention, figures which are needed in the embodiments will be introduced briefly below. It should be understood that the figures below merely show some embodiments of the present invention, and should not be considered as limiting the scope of the present invention. A person skilled in the art can obtain other relevant figures according to these figures, without paying inventive effort.

REFERENCE SIGNS

1—steel wire; 2—metal connecting sheet; 21—burr; 3—insulating member; 4—connecting terminal;

10—metal protective net; 110—first conductor; 111—insulating layer; 120—second conductor; 121—first metal sheet; 1211—first groove; 1212—first metal segment; 1213—first half cylinder; 1214—crimping plate; 122—second metal sheet; 1221—second groove; 1222—second metal segment; 1223—second half cylinder; 123—connecting piece; 124—first spine; 130—insulating bush;

20—protection monitoring system; 210—first monitoring device; 220—second monitoring device; and 230—upper device.

DETAILED DESCRIPTION OF EMBODIMENTS

In order to make the objects, technical solutions and advantages of the embodiments of the present invention clearer, below the technical solutions in the embodiments of the present invention will be described clearly and completely in conjunction with the figures in the embodiments of the present invention. Apparently, some but not all embodiments of the present invention are described. Generally, components in the embodiments of the present invention, as described and shown in the figures herein, can be arranged and designed in different configurations.

Therefore, the detailed description below of the embodiments of the present invention provided in the figures is not intended to limit the scope of protection of the present invention, but merely illustrates chosen embodiments of the present invention. Based on the embodiments of the present invention, all the other embodiments, obtained by a person ordinarily skilled in the art without paying inventive effort, should fall within the scope of protection of the present invention.

It should be noted that similar reference signs and letters represent similar items in the following figures. Therefore, once a certain item is defined in one figure, it is not needed to be further defined or explained in subsequent figures.

It should be indicated that in the description of the embodiments of the present invention, terms such as "first"

and "second" are merely for distinctive description, but should not be construed as indicating or implying relative importance.

Embodiment 1

Figure 1:
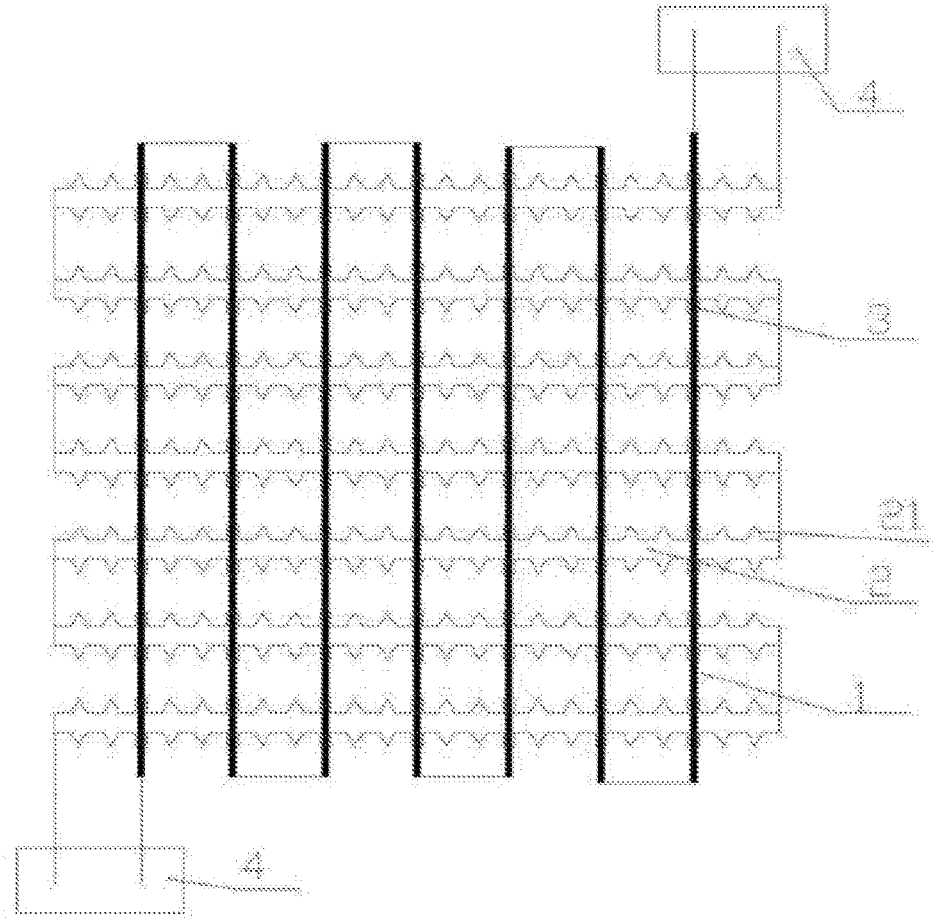
FIG. 1 is a schematic structural view of a metal protective net provided in Embodiment 1 of the present invention, as seen from the front.

As shown in FIG. 1, a metal protective net provided in the present embodiment includes:

a plurality of steel wires 1, where the plurality of steel wires 1 are arranged in parallel, the steel wire 1 is a steel thread or iron thread, and the cross-sectional diameter of the steel wire 1 may be configured according to practical situations; in the present embodiment, the steel wire 1 has a cross-sectional diameter of 4 mm to 5 mm;

a plurality of metal connecting sheets 2, where the plurality of metal connecting sheets 2 are arranged in parallel, and the metal connecting sheets 2 and the steel wires 1 are arranged to intersect with each other at a plurality of intersections without being connected;

insulating members 3, where the insulating members 3 are provided between the steel wires 1 and the metal connecting sheets 2 and located at the intersections, and fixedly connected with the steel wires and the metal connecting sheets;

connecting terminals 4, where both ends of each of the steel wires 1 each are connected with one of the connecting terminals 4, and both ends of each of the metal connecting sheets 2 each are connected with one of the connecting terminal 4; and a monitoring device, where the connecting terminals 4 are electrically connected with the monitoring device.

In the present embodiment, with the provision of the insulating members and the monitoring device, the steel wires and the metal sheets, which form the metal protective net, may be insulated from each other, i.e., not electrically conductive with each other, thereby forming many individual independent loops. If the metal net is broken, an alarm may be sent by the monitoring device (which may be an on-site audible and visual alarm, or may be uploaded in a wired or wireless way to an upper device for alarming). The metal protective net provided in the present embodiment forms a multi-loop information transmitting channel, and enables the integration of protection and monitoring.

As shown in FIG. 1, the metal connecting sheet 2 includes: a first metal sheet, where the first metal sheet is arranged on one side of the plurality of steel wires 1, forming a plurality of intersections; a second metal sheet, where the second metal sheet is arranged on the other side of the plurality of steel wires 1 and located at the plurality of intersections. The steel wire 1 is fixed, at each of the intersections, with one of the insulating members 3 by bonding or riveting. Both the first metal sheet and the second metal sheet are fixedly connected with the insulating member 3. In the present embodiment, both the first metal sheet and the second metal sheet are connected with the insulating member 3 by mold stamping. By providing the first metal sheets and the second metal sheets at both sides of the steel wires, respectively, tight intersections are formed in the metal net as the metal connecting sheets hold the insulating members tightly.

As shown in FIG. 1, in the present embodiment, the insulating member 3 is of a cylindrical shape, and the insulating member 3 is sleeved outside the steel wire 1 and fixedly connected therewith. The first metal sheet and the second metal sheet are arranged opposite to each other, and both of them are bonded or riveted onto an outer wall of the insulating member 3. By setting the insulating member to be in a cylindrical shape and sleeved outside the steel wire, the steel wire can be effectively isolated from the metal sheet.

As shown in FIG. 1, in the present embodiment, the first metal sheet and the second metal sheet are provided thereon with burrs 21, with the burrs 21 located between two adjacent steel wires 1. By providing burrs on the metal sheets, it is possible to prevent people or animals from climbing into a protection zone by force, which can thus further enhance the protective effect in the aspect of hardware.

As shown in FIG. 1, in the present embodiment, every two adjacent steel wires 1 are connected end to end successively via a conducting wire, so as to form a first conductor, and every two adjacent metal connecting sheets 2 are connected end to end successively via a conducting wire, so as to form a second conductor. One end of the first conductor and one end of the second conductor are both connected, via a conducting wire, with one connecting terminal 4, and the other end of the first conductor and the other end of the second conductor are both connected, via a conducting wire, with one connecting terminal 4. In the metal protective net provided in the present embodiment, steel threads are adopted for longitudinal steel wires, and two layers of metal sheets are adopted in the horizontal direction, with the steel threads sandwiched between the two layers of metal sheets. The metal sheets and the steel threads are connected together by stamping with a large mold. Moreover, according to standard of electrical apparatus, the metal sheets and the steel threads form two independent conductive channels, which are insulated from each other, in the vertical direction and in the horizontal direction, respectively. If the metal net is broken, an alarm may be sent by the monitoring device (which may be an on-site audible and visual alarm, or may be uploaded in a wired or wireless way to an upper device for alarming). This enables a multi-loop information transmitting channel, and thus the integration of protection and monitoring.

Embodiment 2

Figure 2:
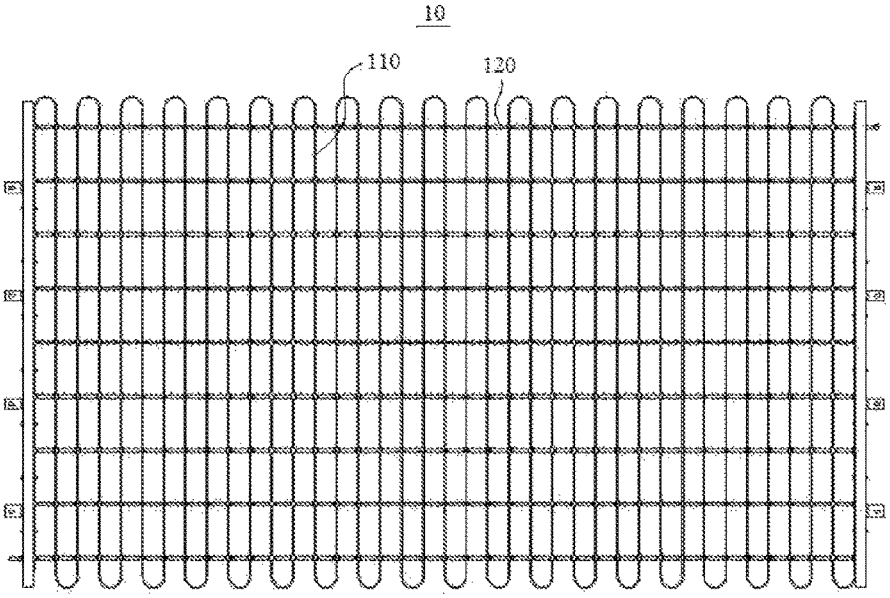
FIG. 2 is a schematic structural view of a metal protective net provided in Embodiment 2 of the present invention, as seen from the front.
Figure 3:
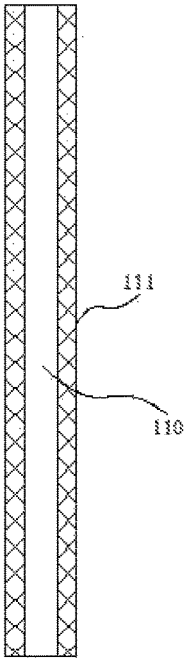
FIG. 3 is a schematic structural view showing one connection between a first conductor and an insulator provided in Embodiment 2 of the present invention.
Figure 4:
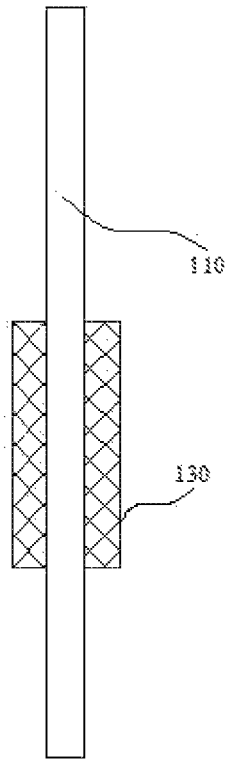
FIG. 4 is a schematic structural view showing another connection between the first conductor and the insulator provided in Embodiment 2 of the present invention.

As shown in FIG. 2, the present embodiment provides a metal protective net 10. The metal protective net 10 includes a plurality of first conductors 110, a plurality of second conductors 120 and insulators (as shown in FIG. 3 and FIG. 4).

The plurality of first conductors 110 are arranged side by side, and connected end to end successively, forming a continuous conductive path. The plurality of second conductors 120 are arranged side by side, and connected end to end successively, forming a continuous conductive path. The first conductors 110 and the second conductors 120 are arranged to intersect with each other, and the first conductors 110 and the second conductors 120 are connected at intersections therebetween to form a net. The insulators are provided at the intersections between the first conductors 110 and the second conductors 120, and the insulators are configured to make the first conductors 110 and the second conductors 120 non-conductive with each other.

In this way, the first conductors 110 and the second conductors 120 form two independent conductive paths, respectively. The first conductors 110 and the second conductors 120 are configured to be electrically connected with a monitoring device (not shown in the figures), and play a role in transmitting electrical signals. When either of the first conductors 110 or the second conductors 120 is damaged, the electrical signal transmission is interrupted, at that time, the monitoring device may send an audible and visual alarm signal, or transmit such information to an upper device. The first conductors 110 and the second conductors 120 intersect with each other and thus form a net, thereby providing physical protection; and meanwhile, the first conductors 110 and the second conductors 120 also play a role in transmitting electrical signals, such that the metal protective net 10 provided in the present embodiment can make it easy to implement the integration of protection and monitoring.

Below the metal protective net 10 provided in the present embodiment will be further described.

Referring to FIG. 2 again, in the present embodiment, one metal conducting wire is bent at several points so as to be in a zigzag shape, which includes a plurality of rectilinear extending portions side by side, and bent portions connecting adjacent rectilinear extending portions. In this case, the rectilinear extending portions form the first conductors 110. It can be understood that the plurality of first conductors 110 also can be obtained in other ways, other than being obtained by bending an integral metal conducting wire. For example, the plurality of first conductors 110 may be independent from each other, and adjacent first conductors 110 are connected via a conductive metal connecting line, thus forming a continuous conductive path.

Referring to FIG. 3, the metal conducting wire is wrapped by an insulating layer 111, and the insulating layer 111 wraps an outer peripheral surface of the metal conducting wire along an extending direction of the metal conducting wire, so that the metal conducting wire is insulated from the outside. A part of the insulating layer 111, which is located at the intersection between the first conductor 110 and the second conductor 120, forms the insulator. In other embodiments, referring to FIG. 4, the insulators may also be a plurality of insulating bushes 130 sleeved on the first conductor 110. Adjacent insulating bushes 130 are spaced apart from each other, so that the first conductor 110 is only insulated at intersections from the second conductors 120, whereas the other portions of the first conductors 110 are exposed.

In the above, the insulators may be made from a material such as TPU (Thermoplastic polyurethane), PVC (Polyvinyl chloride) or ABS (Acrylonitrile butadiene Styrene copolymer).

There may be various ways of connecting the first conductor 110 and the second conductor 120 at the intersections. For example, the first conductor 110 and the second conductor 120 may be bound together by a rope, or the first conductor 110 and the second conductor 120 may be braided together. In the present embodiment, referring to FIG. 5, the connection between the first conductor 110 and the second conductor 120 is realized in a way as follows. The second conductor 120 includes a first metal sheet 121 and a second metal sheet 122 which are arranged opposite to each other. The first metal sheet 121 and the second metal sheet 122 fit together with each other, and the first conductor 110 is sandwiched between the first metal sheet 121 and the second metal sheet 122, thereby realizing the connection between the first conductor 110 and the second conductor 120.

Figure 6:
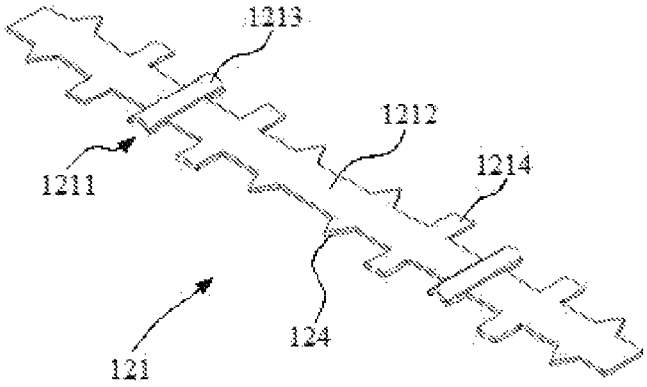
FIG. 6 is a schematic perspective structural view of a first metal sheet provided in Embodiment 2 of the present invention.
Figure 7:
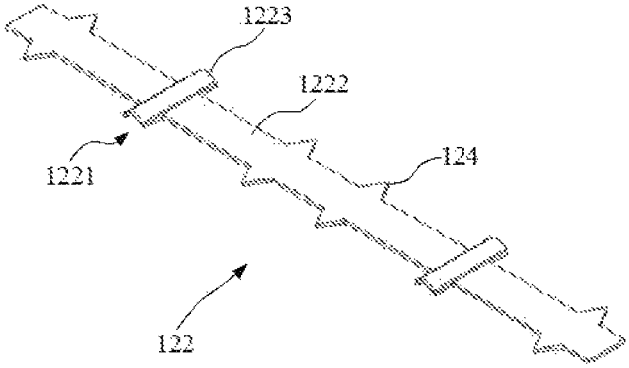
FIG. 7 is a schematic perspective structural view of a second metal sheet provided in Embodiment 2 of the present invention.

Further, referring to FIG. 6 and FIG. 7, the first metal sheet 121 is provided thereon with first grooves 1211, and the second metal sheet 122 is provided thereon with second grooves 1221. The first grooves 1211 correspond one to one to the second grooves 1221. Once the first metal sheet 121 and the second metal sheet 122 fit together with each other, the first groove 1211 and the second groove 1221 face each other and form a receiving space. The first conductor 110 is clamped in the receiving space formed by the first groove 1211 and the second groove 1221. In this way, the first conductor 110 and the second conductor 120 may be more stably connected.

Further, referring to FIG. 6 and FIG. 7, in the present embodiment, the first groove 1211 and the second groove 1221 are realized in a way as follows. The first metal sheet 121 includes a plurality of first metal segments 1212 provided at intervals, and first half cylinder 1213 connecting adjacent first metal segments 1212, with the first half cylinder 1213 defining the first groove 1211. The second metal sheet 122 includes a plurality of second metal segments 1222 provided at intervals, and second half cylinders 1223 connecting adjacent second metal segments 1222, with the second half cylinder 1223 defining the second groove 1221. Once the first metal sheet 121 and the second metal sheet 122 fit together with each other, the first half cylinder 1213 and the second half cylinder 1223 face each other, and are jointly sleeved on the first conductor 110, thereby realizing the connection between the first conductor 110 and the second conductor 120. Both the first metal segment 1212 and the second metal segment 1222 are provided thereon with first spines 124, so as to improve the physical protective effect of the metal protective net 10.

Figure 5:
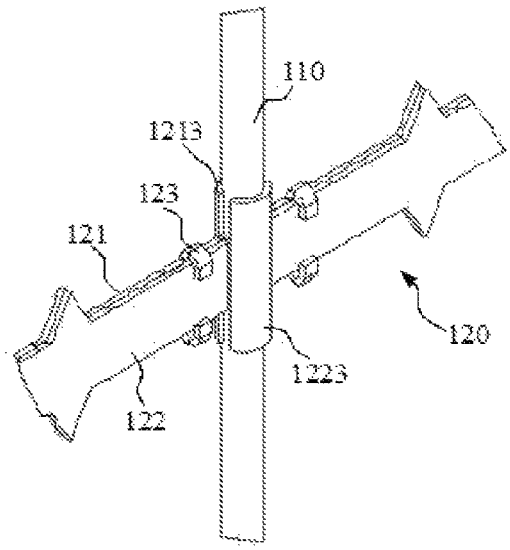
FIG. 5 is a schematic structural view showing a connection between the first conductor and a second conductor provided in Embodiment 2 of the present invention.

The first metal sheet 121 and the second metal sheet 122 may be fixedly connected with each other in a variety ways, for example, welding, bolted connection or riveting. In the present embodiment, the first metal sheet 121 and the second metal sheet 122 are fixedly connected in a way as follows. Referring to FIG. 5 and FIG. 6, the first metal segment 1212 is provided thereon with a protruding crimping plate 1214. The crimping plate 1214 may be bent by stamping so that the second metal segment 1222 is pressed against the first metal segment 1212, thus realizing the fixed connection between the first metal sheet 121 and the second metal sheet 122.

Figure 8:
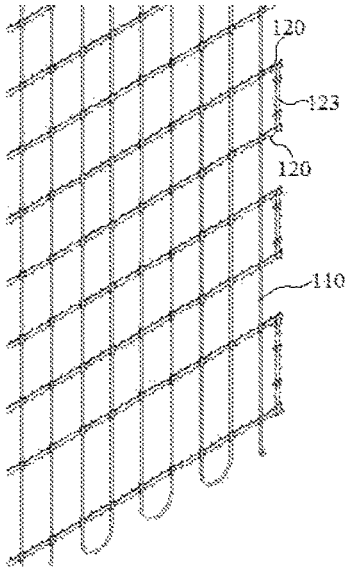
FIG. 8 is a partial schematic structural view of the metal protective net provided in Embodiment 2 of the present invention.

Referring to FIG. 8, in the present embodiment, the plurality of second conductors 120 are connected end to end successively via conductive connecting pieces 123. The connecting piece 123 is provided thereon with a second spine (not shown in the figure), so as to improve the physical protective effect of the metal protective net 10.

Embodiment 3

Figure 9:
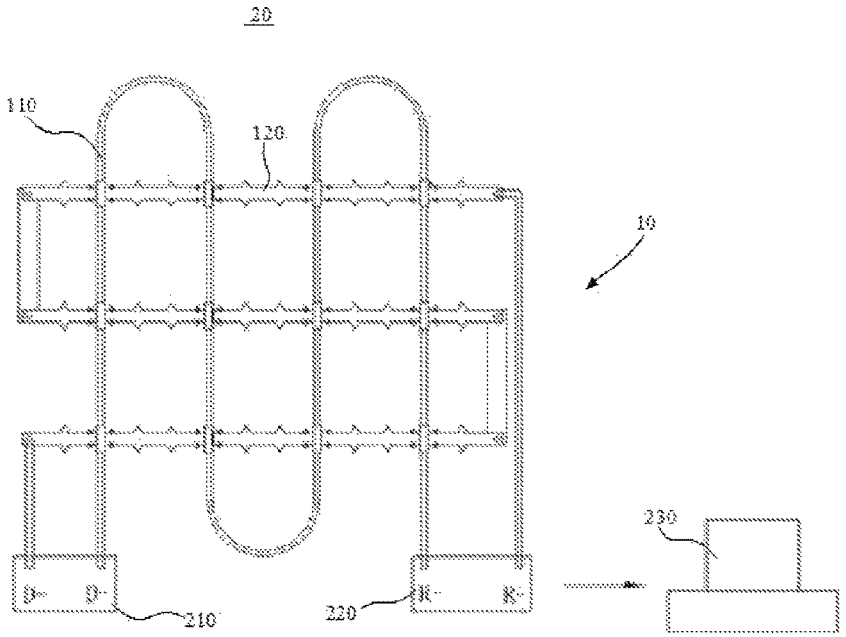
FIG. 9 is a schematic structural view of a protection monitoring system provided in Embodiment 3 of the present invention.

Referring to FIG. 9, the present embodiment provides a protection monitoring system 20. The protection monitoring system 20 includes the metal protective net 10 described in Embodiment 2. The protection monitoring system 20 further includes a monitoring device. In the present embodiment, the monitoring device includes a first monitoring device 210 and a second monitoring device 220. Both ends of the continuous conductive path formed by the first conductors 110 are connected with the first monitoring device 210 and the second monitoring device 220, respectively. Both ends of the continuous conductive path formed by the second conductors 120 are connected with the first monitoring device 210 and the second monitoring device 220, respectively. The first conductors 110 and the second conductors 120 transmit electrical signals between the first monitoring device 210 and the second monitoring device 220. When either of the first conductors 110 or the second conductors 120 is damaged, the electrical signal transmission is interrupted, at that time, the first monitoring device 210 and the second monitoring device 220 would send an alarm signal.

Optionally, in the present embodiment, the protection monitoring system 20 further includes an upper device 230. The upper device 230 is in communication with the first monitoring device 210 and the second monitoring device 220 in a wired or wireless manner. When either of the first conductor 110 or the second conductor 120 is damaged, the first monitoring device 210 and the second monitoring device 220 would send an alarm signal to the upper device 230, thus realizing a remote alarm function. Exemplarily, the upper device 230 may be a computer.

The foregoing only describes partial embodiments of the present invention and is not intended to limit the present invention. For a person skilled in the art, various modifications and variations may be made to the present invention. Any modifications, equivalent replacements, improvements, etc., made within the spirit and principle of the present invention, should be covered by the scope of protection of the present invention.

The invention claimed is:

1. A metal protective net, comprising:

a plurality of steel wires (1), wherein the plurality of steel wires (1) are arranged in parallel;

a plurality of metal connecting sheets (2), wherein the plurality of metal connecting sheets (2) are connected end to end successively and arranged in parallel, and the metal connecting sheets (2) and the steel wires (1) are arranged to intersect with each other at a plurality of intersections without being connected;

insulating members (3), wherein the insulating members (3) are provided between the steel wires (1) and the metal connecting sheets (2) and located at the intersections, and fixedly connected with the steel wires (1) and the metal connecting sheets (2);

connecting terminals (4), wherein both ends of each of the steel wires (1) each are connected with one connecting terminal (4), and both ends of each of the metal connecting sheets (2) are connected with two different connecting terminals (4); and a monitoring device, wherein the connecting terminals (4) are electrically connected with the monitoring device.

2. The metal protective net according to claim 1, wherein the metal connecting sheet (2) comprises:

a first metal sheet, wherein the first metal sheet is arranged on one side of the plurality of steel wires (1), forming a plurality of intersections;

a second metal sheet, wherein the second metal sheet is arranged on the other side of the plurality of steel wires (1) and located at the plurality of intersections;

the steel wire (1) is fixed, at each of the plurality of intersections, with one of the insulating members (3) by bonding or riveting, and the first metal sheet and the second metal sheet are respectively located at both sides of the steel wire and fixedly connected onto an outer side wall of the insulating member (3).

3. The metal protective net according to claim 2, wherein both the first metal sheet and the second metal sheet are fixedly connected with the insulating member (3) by mold stamping.

4. The metal protective net according to claim 3, wherein the insulating member (3) is of a cylindrical shape, and the insulating member (3) is sleeved outside the steel wire (1), and fixed with the steel wire by bonding or riveting.

5. The metal protective net according to claim 4, wherein the first metal sheet and the second metal sheet are provided thereon with burrs (21), with the burrs 21 located between adjacent two of the steel wires (1).

6. The metal protective net according to claim 5, wherein every adjacent two of the steel wires (1) are connected end to end successively via a conducting wire, so as to form a first conductor, every adjacent two of the metal connecting sheets (2) are connected end to end successively via a conducting wire, so as to form a second conductor, one end of the first conductor and one end of the second conductor are both connected, via a conducting wire, with one connecting terminal (4), and the other end of the first conductor and the other end of the second conductor are both connected, via a conducting wire, with one connecting terminal (4).

7. The metal protective net according to claim 1, wherein the steel wire (1) is a steel thread or iron thread having a cross-sectional diameter of 4 mm to 5 mm.

8. A metal protective net, comprising:

a plurality of first conductors, wherein the plurality of first conductors are arranged side by side, and connected end to end successively, forming a continuous conductive path;

a plurality of second conductors, wherein the plurality of second conductors are arranged side by side, and connected end to end successively, forming a continuous conductive path; and insulators, wherein the first conductors and the second conductors are arranged to intersect with each other, and the first conductors and the second conductors are connected at intersections to form a net; the insulators are provided at the intersections between the first conductors and the second conductors, and the insulators are configured to make the first conductors and the second conductors non-conductive with each other.

9. The metal protective net according to claim 8, wherein the plurality of first conductors are formed by bending one metal conducting wire at several points.

10. The metal protective net according to claim 9, wherein the metal conducting wire is wrapped by an insulating layer, and a part of the insulating layer, which is located at the intersection between the first conductor and the second conductor, forms the insulator.

11. The metal protective net according to claim 8, wherein the insulator is an insulating bush sleeved on the first conductor.

12. The metal protective net according to claim 8, wherein the second conductor comprises a first metal sheet and a second metal sheet which are arranged opposite to each other, and the first conductor is sandwiched between the first metal sheet and the second metal sheet.

13. The metal protective net according to claim 12, wherein the first metal sheet and the second metal sheet are fixedly connected by stamping.

14. The metal protective net according to claim 12, wherein the first metal sheet is provided thereon with a first groove, the second metal sheet is provided thereon with a second groove with the second groove being opposite to the first groove, and the first conductor is clamped in the first groove and the second groove.

15. The metal protective net according to claim 14, wherein the first metal sheet comprises a plurality of first metal segments provided at intervals, and first half cylinders connecting adjacent two of the first metal segments, with the first half cylinder defining the first groove; the second metal sheet comprises a plurality of second metal segments provided at intervals, and second half cylinders connecting adjacent two of the second metal segments, with the second half cylinder defining the second groove.

16. The metal protective net according to claim 8, wherein the plurality of second conductors are provided thereon with first spines.

17. The metal protective net according to claim 8, wherein the plurality of second conductors are connected end to end successively via a conductive connecting piece.

18. The metal protective net according to claim 17, wherein the connecting piece is provided thereon with a second spine.

19. A protection monitoring system, comprising the metal protective net according to claim 8, wherein the protection monitoring system further comprises a monitoring device, and the monitoring device is electrically connected with both the first conductors and the second conductors.

20. The protection monitoring system according to claim 19, wherein the protection monitoring system further comprises an upper device in communication with the monitoring device.

* * * * *